US006183123B1

(12) United States Patent
Sniegowski et al.

(10) Patent No.: US 6,183,123 B1
(45) Date of Patent: Feb. 6, 2001

(54) FIBER ADDITIVE CONCRETE MANUFACTURING METHOD

(75) Inventors: Richard M. Sniegowski, Lemont; Arthur Robert Osborn, Joliet, both of IL (US)

(73) Assignee: K-Five Construction Corporation, Lemont, IL (US)

( * ) Notice: Under 35 U.S.C. 154(b), the term of this patent shall be extended for 0 days.

(21) Appl. No.: 09/168,215

(22) Filed: Oct. 7, 1998

(51) Int. Cl.[7] ..... B28C 7/04

(52) U.S. Cl. ..... 366/8; 366/16; 366/18; 366/30; 366/39

(58) Field of Search ..... 366/1, 2, 6, 8, 366/18, 30, 33, 37, 41, 133, 134, 141, 153.2, 153.3, 39; 414/422, 425, 810; 206/497, 597; 53/442

(56) References Cited

U.S. PATENT DOCUMENTS 3,885,774 * 5/1975 Harris et al. .
3,986,611 * 10/1976 Dreher .
4,940,335 * 7/1990 Gibson .

FOREIGN PATENT DOCUMENTS 2-89795 * 3/1990 (JP) .

* cited by examiner

*Primary Examiner*—Tony G. Soohoo
(74) *Attorney, Agent, or Firm*—James W. Potthast; Potthast & Associates

(57) ABSTRACT

A method of manufacturing concrete with a fiber additive and other ingredients including the steps of mechanically manipulating a shipping container (36) having a gross amount of fiber additive (50) substantially greater than the an amount susceptible to unaided manual handling with a mechanical manipulator to dump the gross amount of fiber additive (50) from the shipping container (36) into an additive hopper (46) moving at least some of the fiber additive (50) dumped in the additive hopper (46) to an additive hopper-bin (20) by means of a mechanically powered fiber conveyor (48) and conveying a preselected amount of the fiber additive (50) from the additive hopper-bin (20) to a mixer (14) for mixing with the other ingredients of the concrete being made.

15 Claims, 4 Drawing Sheets

FIBER ADDITIVE CONCRETE MANUFACTURING METHOD

BACKGROUND OF THE INVENTION

This invention relates generally to apparatus and methods for concrete manufacturing and, more particularly, to such apparatus and methods in which the concrete includes a fiber ingredient.

Referring to FIG. 1, the prior art system of manufacturing concrete with steel fiber additive 10 includes a cement/flyash silo 12 with a dump drum 14, an aggregate bin assembly 16 with a scale 18 and an aggregate hopper assembly 20 all resting on a generally flat section of ground or floor 22. The aggregate hopper assembly 20 includes three compartmental sections for separately receiving through open tops 20A and capable of separately holding three different types of aggregate, such as CA-7 coarse, A-2 fine, rocks and sand. After the aggregate is loaded by front loaders in through the tops of the compartmental sections, selected amounts are allowed to fall through individual gate controlled openings in the bottom 20B of the aggregate hopper assembly 20 onto three underlying, parallel, aggregate belt conveyors 24, respectively. The three conveyors 24 separately convey from the three separate aggregate hoppers from the bottom 20B to the tops 16A of the compartmental sections of the aggregate bin assembly 16.

The amount of aggregate in each of the three compartmental sections is weighed by the associated scales 18 and selected amounts are then passed to the bottom of a mixed aggregate belt conveyor 26. The conveyor 26 receives aggregate from any and all of the selected compartmental sections of the aggregate bin assembly 16, and the aggregate from the different compartmental sections are dumped together on the one conveyor 26. The aggregate mix on the conveyor 26 is conveyed to an aggregate inlet 14A of the dump drum 14. In addition a selected amount of cement/flyash mixture is allowed to pass into a cement/flyash inlet 14B of the dump drum 14 by gravity feed through a chute 28.

The mixture of the selected amount of cement/flyash and the weighed and selected amounts the three possibly different types of aggregate are then mixed in the dump drum during rotation of the drum. Water is then added into the drum 14 from the water feed tube 14C from water source 14D to be mixed with the dry aggregate. After this wet concrete mixture has been blended in the dump drum 14, it is available to be gravity feed loaded from the dump drum 14 into a succession of dump trucks 27 for conveyance of the mixed wet concrete to another site.

In the case of the dry concrete recipe or formula calling for the inclusion of steel fibers, the steel fibers are packaged in bags 30 weighing approximately forty pounds that are delivered to the site and are manually opened, lifted and hand dumped onto the aggregate belt conveyor 26 from a platform. Alternatively, the bags are manually dumped onto one of the three aggregate conveyors 24 for conveyance to the conveyor 26, or onto a separate fiber conveyor 32 for conveyance via the aggregate bin assembly 16 and the aggregate belt conveyor 26 to the dump drum 14. In the case of the preparation of premixed concrete on site, the dry concrete formula apart from the fiber additive is delivered into a premix cement truck (not shown) without mixing in the dump drum 14, and a separate, special additive conveyor (not shown) is used to move the fiber additive to a load receiving opening of the cement truck into which the other ingredients are also received. The forty pound bags of additive 30 are opened manually and manually dumped onto this special additive conveyor.

The present inventors have determined that this process of manufacturing concrete with fiber additive is disadvantageously labor intensive, inefficient and wasteful of material due to breakage of the forty pound bags of fiber additive and spillage during manual handling and dumping of the bags.

SUMMARY OF THE INVENTION

In accordance with the present invention, the disadvantages of the known apparatus and processes for manufacturing concrete with fiber additive are overcome by elimination of the need for manual labor to open and dump individual forty pound bags of fiber additive.

It is therefore the principle object of the invention to provide a method of manufacturing concrete with a fiber additive and other ingredients, comprising the steps of mechanically manipulating a shipping a shipping container having a gross amount of fiber additive substantially greater than the an amount susceptible to unaided manual handling with a mechanical manipulator to dump the gross amount of fiber additive from the shipping container into an additive hopper, moving at least some of the fiber additive dumped in the additive hopper to an additive bin by means of a mechanically powered conveyor; and conveying a preselected amount of the fiber additive from the additive bin to a mixer for mixing with the other ingredients of the concrete being made.

It a further object of the invention to provide a concrete fiber additive shipping and handling module, having a rectilinear shipping container with a bottom and a closed top and containing a gross amount of steel fiber additive substantially greater than an amount susceptible to unaided manual handling with a shipping pallet underlying the bottom of the shipping container; and means for releasably attaching the shipping pallet to the shipping container.

BRIEF DESCRIPTION OF THE DRAWINGS

The foregoing advantageous features of the present invention will be described further and other advantageous features will be made apparent from the following detailed description of the preferred embodiment of the invention, i.e. the one embodiment of the invention that is presently believed to be the best way of practicing the invention, that is given with reference to the several figures of the drawings, in which.

DETAILED DESCRIPTION

Figure 2:
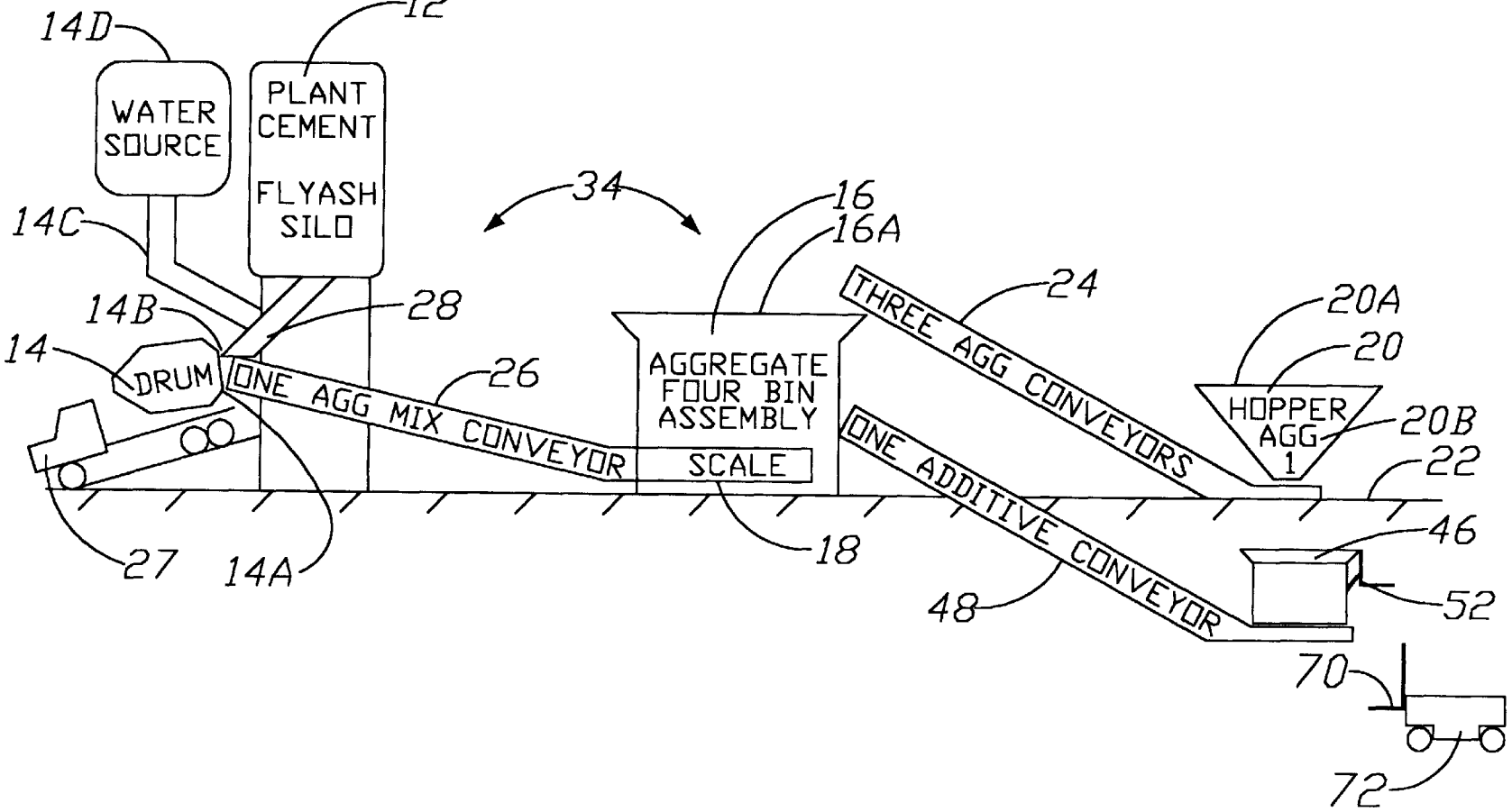
FIG. 2 is a schematic, pictorial representation of the system of manufacturing concrete with fiber additive of the present invention.
Figure 4:
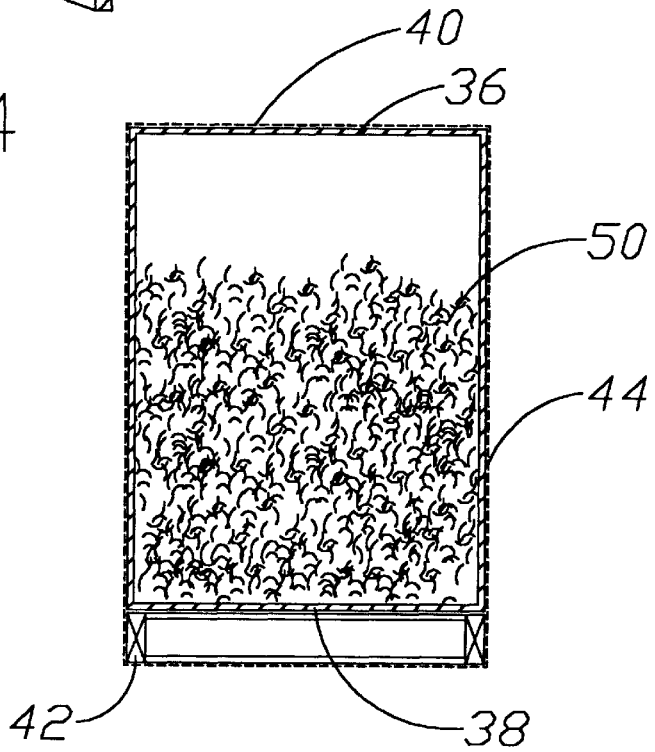
FIG. 4 is a side elevational view of the container shrink wrapped to the shipping pallet.

Referring to FIG. 2 and FIG. 4 showing the preferred embodiment, the concrete fiber additive shipping and handling module 34, having a rectilinear shipping container 36 containing a gross amount of steel fiber additive 50 substantially greater than an amount susceptible to unaided manual handling on the order of 1750 pounds. As seen in FIG. 4 the rectilinear shipping container 36 has a bottom 38 and a closed top 40 and a shipping pallet 42 underlying the bottom of the shipping container 36 which is releasably attached to the shipping pallet with a shrink wrap plastic 44. The shrink-wrap plastic tightly envelops both the shipping container 36 and the shipping pallet 42 together with the shipping pallet. The shipping container 36 is made of heavy cardboard the rigidity of which is re-enforced by the shrink wrap plastic 44.

Figure 1:
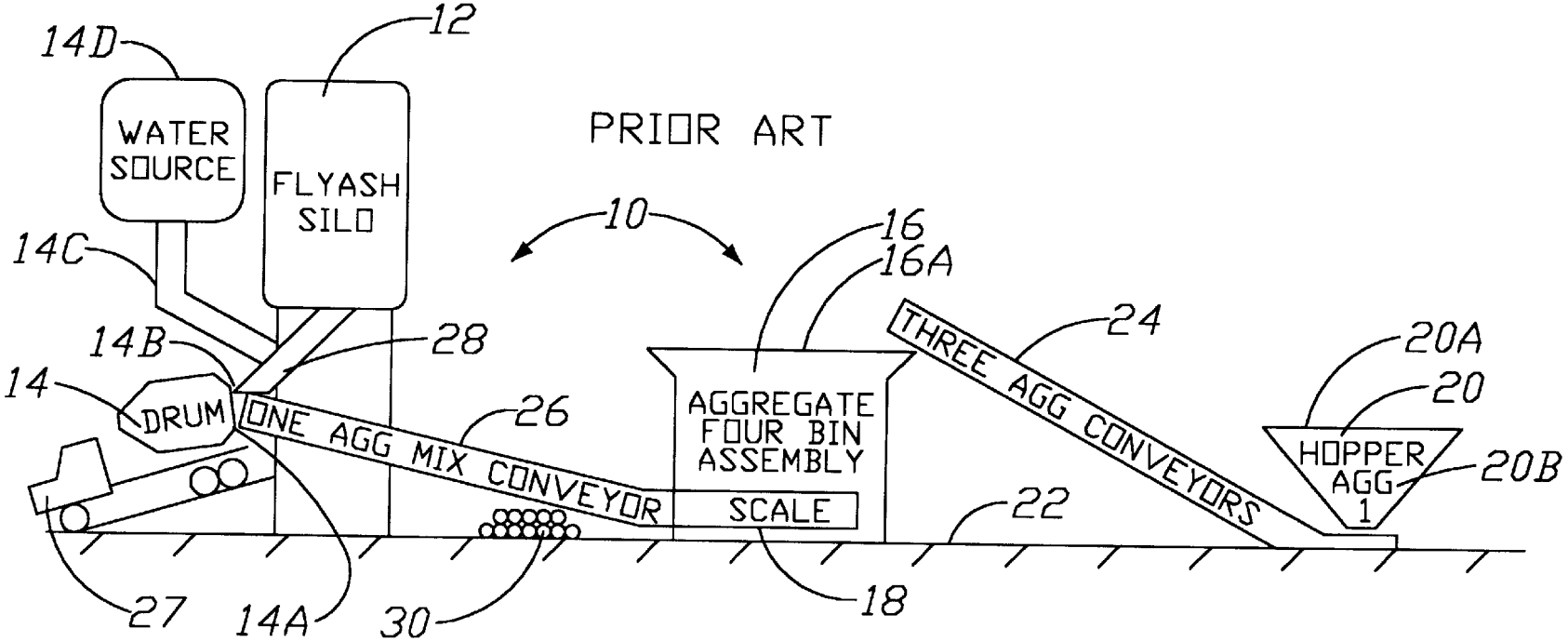
FIG. 1 is schematic, pictorial representation of the prior art system of manufacturing concrete with fiber additive.

Referring now to FIG. 2, the preferred embodiment 34 similar to the prior art as shown in FIG. 1 showing a method of manufacturing concrete with fiber additive and other ingredients by mechanically manipulating the rectilinear shipping container 36 having a gross amount of fiber additive, approximately 1750 pounds, substantially greater than the amount susceptible to unaided manual handling of the 40 pound packaged bags of steel fiber 30 with a mechanical manipulator, or power lift, to dump the gross amount of fiber additive from the shipping container into an additive hopper 46. This involves moving at least some of the fiber additive dumped in the additive hopper 46 to the aggregate additive bin 16 by means of a mechanically powered additive conveyor 48 by conveying preselected amount of the fiber additive from the additive hopper 46 to a mixer, of aggregate bin assembly 16, like that of the prior art but having a four bin assembly for mixing the three types of aggregate from the aggregate hopper 20 for mixing with the other ingredients of the concrete being made.

Figure 3A:
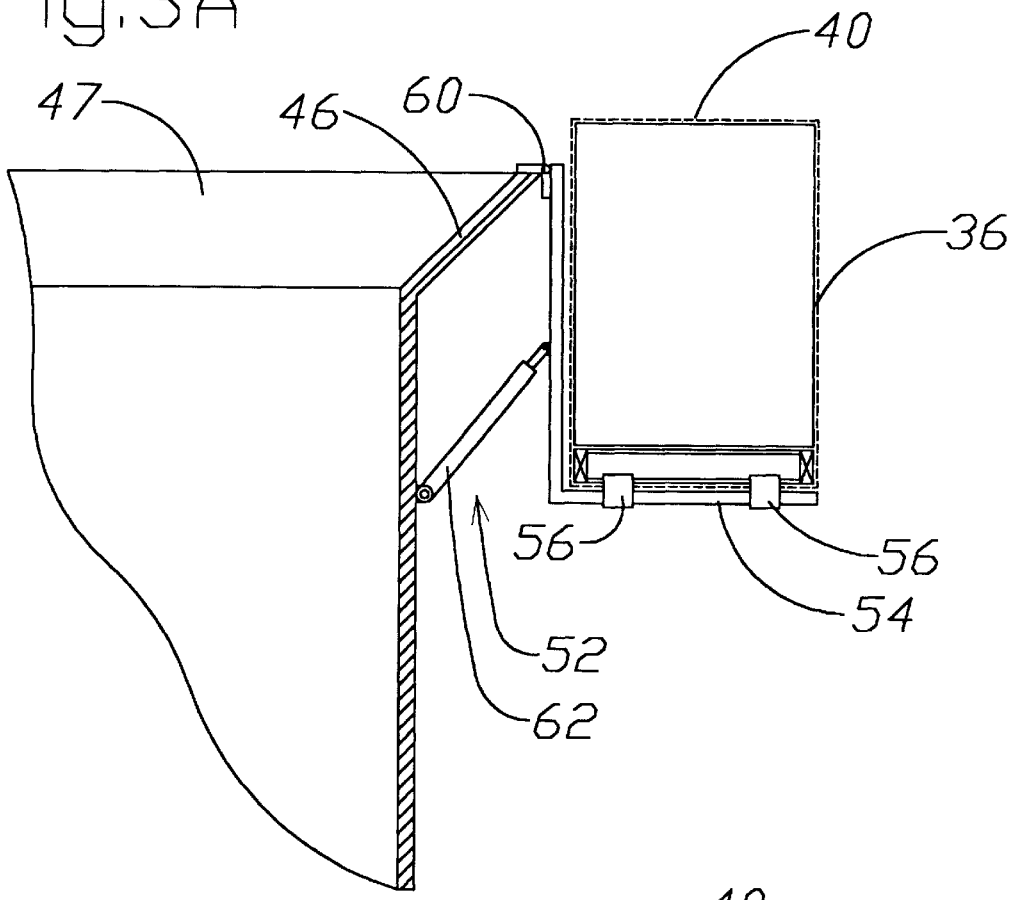
FIG. 3A is a side sectional view of a preferred embodiment of the fiber hopper assembly with an attached mechanical manipulator previously shown only schematically in FIG. 2 in the load position.

The container, as seen in FIG. 4, is shipped on top of a shipping pallet 42 and is transported by a lift truck, or forklift, by releasably engaging the shipping pallet 42 with the forks 70 of the forklift 72 in underlying support of the pallet 42 during transport as seen in FIG. 2. The pallet 42 is attached to the shipping container 36 by shrink wrapping the container to the pallet 42 with a suitable shrink-wrap plastic 44 prior to transport to the power lift. The shipping container is transported, with the forklift, from a remote storage location to the power lift 52. The shrink-wrap adjacent to the open top of the container 36 is then cut open to allow the steel fiber additive to be dumped from the container and into the additive hopper. The shipping container is then lifted into position and is engaged with and supported by the power lift with a lift platform 54 as seen in FIG. 3A.

The pallet 42 is releasably attached to the power lift platform 54 prior to lifting the shipping container 36 by releasably attaching a pair of straps around the pallet and the lift platform. The straps 56 are looped through the pallet 42 and around the bottom of the lift platform 54 and are clamped taut.

The power lift 52 is a hydraulic lift having a lift platform 54 and a front wall 66 which the front wall is hingeably attached, with a hinge 60, to the mouth 47 which laterally extends away from the side wall of the additive hopper 46 and is a funnel like collar surrounding the open top. A manually actuatable hydraulic arm 62 is attached to a side wall of the additive hopper 46 and the front wall of the lift platform. The hydraulic arm 62 extends the front wall of the lift platform to a dumping position substantially past a horizontal position to enable dumping of the material into the additive hopper. The front wall 66, when in the dump position, provides underlying support to a side of the shipping container 36.

Figure 3B:
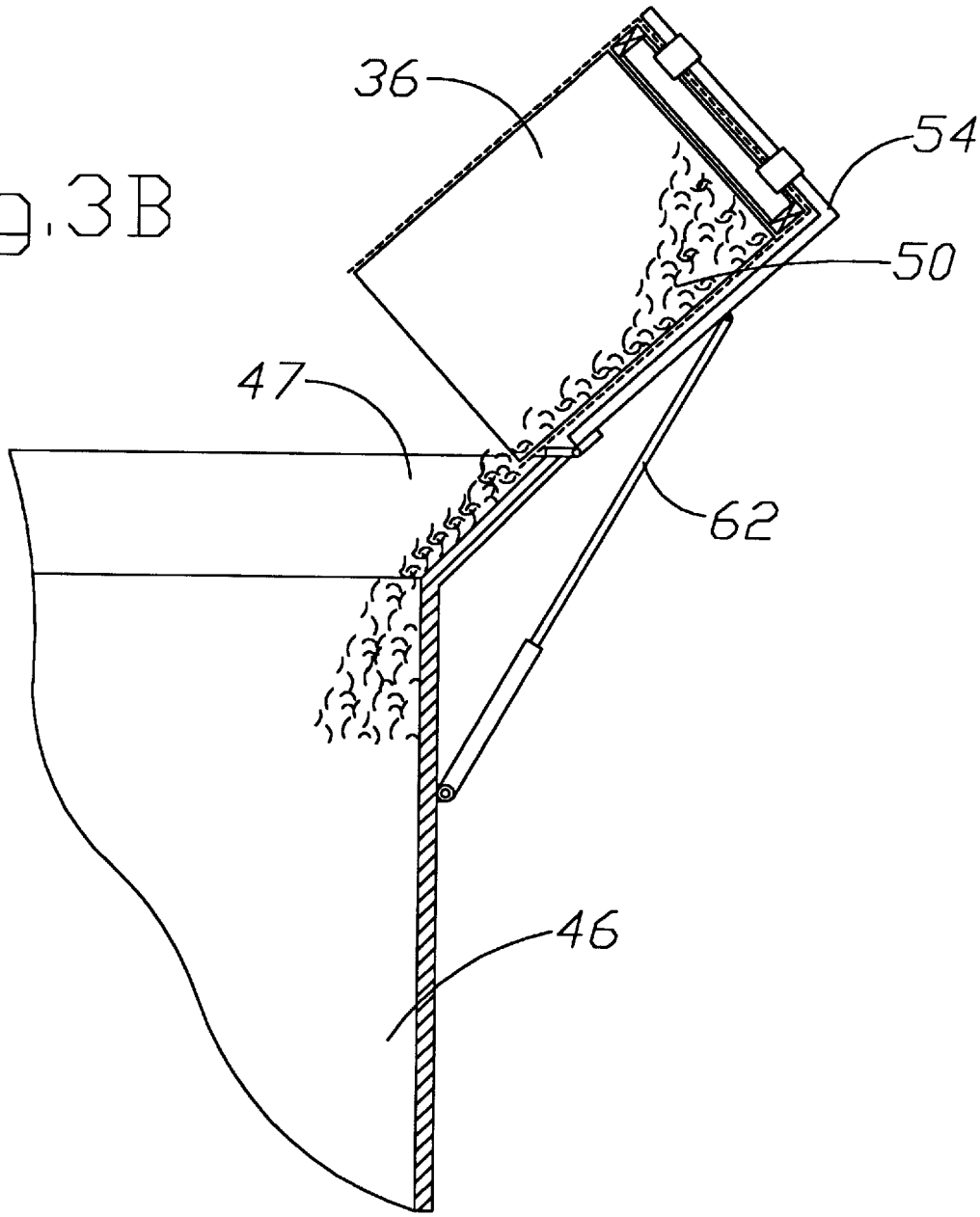
FIG. 3B is a side sectional view of a preferred embodiment of the fiber hopper assembly with an attached mechanical manipulator similar to the view of FIG. 3B but with the mechanical manipulator in the dump position.

Referring now to FIG. 3B as hydraulic pressure is applied to the hydraulic arm 62 the arm extends pivoting the lift platform 54 and shipping container 36 from a generally horizontal, upward facing, loading position spaced laterally from and beneath the open top of the additive hopper 46 to a downward facing, dumping position spaced over and above the open top to dump the fiber additive out of an open top the shipping container and into the additive hopper.

A scale located within the additive hopper weighs the fiber additive within the bin and determines, by weight, a preselected amount needed to be conveyed to the aggregate four bin assembly 16. The preselected amount of fiber additive is conveyed by the additive conveyor 48 from the additive hopper 46 and to the aggregate four bin assembly 16 where it is mixed with the other ingredients to complete the mixture.

Referring again to FIG. 2, an aggregate bin assembly 16 with a scale 18 and an aggregate hopper assembly 20 are all resting on a generally flat section of ground or floor 22. The aggregate hopper assembly 20 includes three compartmental sections for separately receiving through open tops 20A and separately holding three different types of aggregate, such as such as CA-7 coarse, A-2 fine, rocks and sand. After the aggregate is loaded by front loaders in through the tops of the compartmental sections, selected amounts are allowed to fall through individual gate controlled openings in the bottom 20B of the aggregate hopper assembly 20 onto three underlying, parallel, aggregate belt conveyors 24, respectively. The three conveyors 24 separately convey the three different types of aggregate from the bottom 20B to the tops 16A of the compartmental sections of the aggregate bin assembly 16.

The amount of aggregate in each of the three compartmental sections is weighed by the associated scales 18 and selected amounts are then passed to the bottom of a mixed aggregate belt conveyor 26. The conveyor 26 receives aggregate from any and all of the selected compartmental sections of the aggregate bin assembly 16, and the aggregate from the different compartmental sections are dumped together on the one conveyor 26. The aggregate mix on the conveyor 26 is conveyed to an aggregate inlet 14A of the dump drum 14. In addition a selected amount of cement-fly ash mixture is allowed to pass into a cement-fly ash inlet 14B of the dump drum 14 by gravity feed through a chute 28.

The mixture of the selected amount of cement-fly ash and the weighed and selected amounts the three possibly different types of aggregate are then mixed in the dump drum during rotation of the drum. Water is then added into the drum 14 from the water feed tube 14C from water source 14D to be mixed with the dry aggregate. After this wet concrete mixture has been blended in the dump drum 14, it is available to be gravity feed loaded from the dump drum 14 into a succession of dump trucks 27 for conveyance of the mixed wet concrete to another site.

In the case of the dry concrete recipe or formula calling for the inclusion of steel fibers, the steel fibers are conveyed from the additive hopper 46 via the power additive conveyor 48 and into a forth compartment of the aggregate bin assembly 16 where it is weighed to provide the correct amount.

While a detailed description of the preferred embodiment of the invention has been given, it should be appreciated that many variations can be made thereto without departing from the scope of the invention as set forth in the appended claims.

What is claimed is:

1. A method of manufacturing concrete with a fiber additive and other ingredients, comprising the steps of:

mechanically manipulating a shipping container having a gross amount of fiber additive substantially greater than an amount susceptible to unaided manual handling with a powered mechanical manipulator to dump the gross amount of fiber additive from the shipping container into an additive hopper;

moving at least some of the fiber additive dumped in the additive hopper to an additive bin by means of a mechanically powered conveyor; and conveying a preselected amount of the fiber additive from the additive bin to a mixer for mixing with the other ingredients of the concrete being made.

2. The method of claim 1 including the step of transporting the shipping container from one location remote from the powered mechanical manipulator to a position in which the shipping container is engaged with and supported by the powered mechanical manipulator.

3. The method of claim 2 including the step of shipping the shipping container on top of a shipping pallet, and in which the step of transporting is performed by a lift truck releasably engaging the shipping pallet in underlying support during transport.

4. The method of claim 3 including the step of attaching the pallet to the shipping container prior to transport to the powered manipulator.

5. The method of claim 4 in which the step of attaching the pallet to the shipping container is performed by shrink wrapping the pallet and the shipping container together with shrink wrap plastic.

6. The method of claim 5 including the step of releasably attaching the pallet to the powered mechanical manipulator prior to the step of mechanically manipulating the shipping container.

7. The method of claim 4 including the step of attaching the pallet to the powered mechanical manipulator prior to the step of mechanically manipulating the shipping container.

8. The method of claim 1 including the step of shrink wrapping the shipping container to the pallet with shrink wrap plastic prior to the step of mechanically manipulating.

9. The method of claim 1 including the step of releasably fastening the shipping container to the power mechanical manipulator prior to dumping the gross amount of fiber additive from the shipping container into the additive hopper.

10. The method of claim 9 in which the step of manipulating includes the step of pivoting the shipping container from a generally horizontal, upward facing, loading position spaced laterally from and beneath an open top of the additive bin to a downward facing, dumping position spaced over and above the open top to dump the fiber additive out of an open top of the shipping container and into the additive hopper.

11. The method of claim 1 in which the step of manipulating includes the step of pivoting the shipping container from a generally horizontal, upward facing, loading position spaced laterally from and beneath an open top of the additive bin to an at least partially downward facing, dumping position spaced over and above the open top to dump the fiber additive out of an open top of the shipping container and into the additive hopper.

12. The method of claim 11 in which the step of pivoting is performed by actuating a powered extendable arm for pivoting a container support member underlying the shipping container between the loading position and the dumping position.

13. The method of claim 1 in which the step of conveying a preselected amount of the fiber additive includes the step of weighing the fiber additive while contained in the additive bin.

14. The method of claim 13 in which the step of conveying includes conveying the preselected amount of fiber additive to the mixer on a conveyor that is also used to convey selected amounts of at least some of the other ingredients.

15. The method of claim 1 in which the step of conveying includes conveying the preselected amount of fiber additive to the mixer on a conveyor that is also used to convey selected amounts of at least some of the other ingredients.

* * * * *